United States Patent [19]

Ozeryansky

[11] 4,052,982

[45] Oct. 11, 1977

[54] MASSAGE HOOP

[76] Inventor: Gennady Ozeryansky, Regency Park, 105 E, Guilderland, N.Y. 12084

[21] Appl. No.: 729,264

[22] Filed: Oct. 4, 1976

[51] Int. Cl.[2] ..... A61H 15/00

[52] U.S. Cl. ..... 128/57; 46/47

[58] Field of Search ..... 128/57, 58, 24.3; 46/47; 272/127

[56] References Cited

U.S. PATENT DOCUMENTS

| | | | |
|---|---|---|---|
| 3,079,728 | 3/1963 | Melin | 46/47 |
| 3,190,032 | 6/1965 | Green et al. | 46/47 X |
| 3,957,039 | 5/1976 | Ehren | 128/58 |

*Primary Examiner*—Lawrence W. Trapp

*Attorney, Agent, or Firm*—Webb, Burden, Robinson & Webb

[57] ABSTRACT

A rigid hoop having a circumference and weight suitable for rotation about a person's waist by a hula-type motion of the person includes a multiplicity of protrusions fitted about and radially extending inwardly from the inside outer surface of the hoop so that the protrusions successively engage the waist as the hoop is rotated. The protrusions have a height, measured from the inside outer surface of the hoop, of from 3 to about 30 millimeters and are shaped and spaced so as to create a multiplicity of distinct depressions as they engage the waist. The protrusions may be spaced in groups, carried on a special insert, inflatable or configured, so as to maximize skin penetration in a therapeutic manner.

13 Claims, 8 Drawing Figures

MASSAGE HOOP

FIELD OF THE INVENTION

This invention relates to massage devices in general and, more particularly, to hoop-like massage devices that stimulate the dermis and muscle.

PRIOR ART

Devices which include a hoop and are operated through a hula-type motion are being marketed presently as toys and amusement devices. However, these devices are used for recreational purposes an no therapeutic benefits inure to the user other than a mild exercise resulting from the undulating hip movements required to maintain the rotation of the hula loop about the waist of the user.

In particular, U.S. Pat. No. 3,079,728 was issued for a hula loop which includes, inter alia, a "friction surface" consisting of either several parallel and continuous ridges extending circumferentially along the inner periphery of the hoop, or a roughened area of serrations such as achieved by a knurling process. According to the disclosure, the purpose of this friction surface is to prevent the hoop from slipping down the waist of the user. The therapeutic effect, if any, the friction surface may have on the skin or the waist of the user would be negligible.

U.S. Pat. Nos. 3,066,438 and 3,190,032 describe hula hoops having a series of teeth or ribs extending from the inner periphery. The function of these minute teeth or ribs is to engage a ring movably mounted on the hoop to produce a noise. Again, the effect of these projections on the waist of the user would be negligible. The teeth and rib positions are spaced to vary the noise produced when the projections engage the above mentioned ring.

There are massage devices which effect the skin in a manner similar to that of the massage hoop. However, these devices employ an electric or water power source to drive a vibrating means which produces the desired massaging effect. The presence of these elements in other massage devices adds to their cost and limits their portability. Therefore, a need exists for a massage device which is completely portable and which operates without the use of costly power sources or vibrating means.

SUMMARY OF THE INVENTION

Use of my invention creates a massaging effect on the waist of the user by repeatedly compressing the dermis of the skin on the waist, thereby stimulating nerve endings and increasing the flow of blood through the veins contained in the dermis. As my invention is rotated about the waist of the user, centrifugal force created by such rotation drives the inside outer surface of the hoop towards the waist. Consequently, a multiplicity of protrusions located on the inside outer surface of my massage hoop are driven into the waist and compress the dermis in the area of contact. It is the outermost portion of the protrusions that comes in contact with the waist, rather than the inside outer surface itself. This results in an area of contact between my massage hoop and the waist smaller than that of conventional recreational hula hoops thereby increasing the force per unit area of the massage hoop in the dermis. This increased force depresses the protrusions into the dermis, compressing it, resulting in the massaging effect.

My invention has no need for the power sources or driving means of other massage devices since the massaging effect is a product of rotational forces exerted by my invention on the dermis and is generated by properly coordinated body movements of the user.

My invention is a rigid hoop having a circumference and weight suitable for rotation about a person's waist by a hula-type motion of the person and includes a multiplicity of protrusions fitted about and radially extending inwardly from the inside outer surface of the hoop so that the protrusions successively engage the waist as the hoop is rotated. The protrusions have a height, measured from the inside outer surface of the hoop, of from 3 to about 30 millimeters and are shaped and spaced so as to create a multiplicty of distinct depressions as they engage the waist.

DESCRIPTION OF THE PREFERRED EMBODIMENTS

Figure 1:
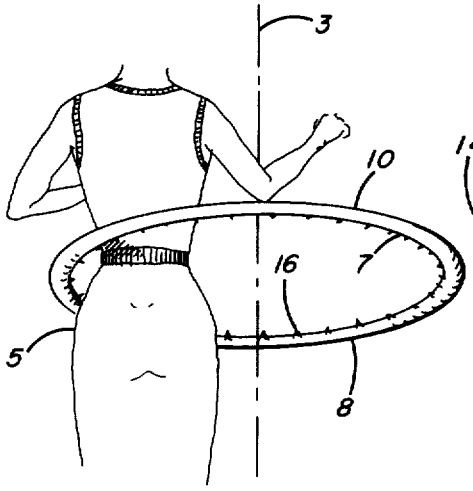
FIG. 1 is a view of the massage hoop being manipulated by a user.
Figure 2:
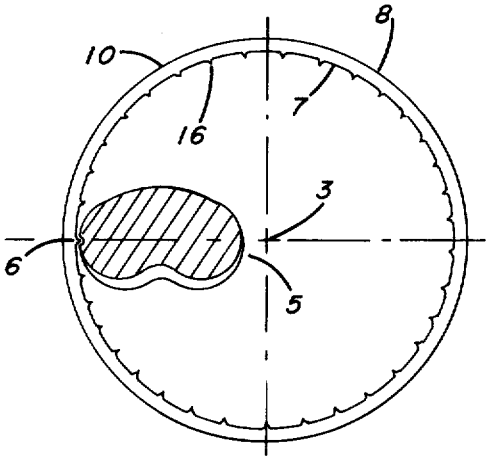
FIG. 2 is a plan view of the massage hoop disposed about the waist of a user showing the position of the protrusions relative to the hoop and user.

My massage hoop, generally designated 10, comprises a hoop member 8 similar to a hula hoop having a multiplicity of protrusions, generally designated 16, fitted on the inside outer surface 7 thereof and extending radially inwardly toward the central axis 3 of the massage hoop, FIGS. 1 and 2.

In FIGS. 1 and 2, I have illustrated my massage hoop disposed about the waist of a user 5. Through properly coordinated body movements, the hoop will rotate about the waist in a generally horizontal plane, the protrusions depressing the dermis of the waist at the point of contact 6, FIG. 2. As the hoop is rotated, the point of contact progresses about the waist of the user.

In general, the massaging effect of my invention can be varied from a light massage or slight compression of the dermis to a deep massage of the dermis and muscles. This variation is achieved by altering the height, spacing and cross-sectional area of the protrusions and the weight of the hoop. However, because the height, spacing and cross-sectional area of the protrusions and the weight of the hoop act together to create the massage effect, there exists certain critical relationships among these dimensions as well as critical ranges within which each dimension may vary. If the hoop and protrusion dimensions do not possess these relationships or fall within these ranges, the resultant massaging effect will be negligible. For example, if the protrusions are spaced apart an insufficient distance, the area of contact between the protrusions and the waist will be increased, resulting in a reduced force per unit area and a compression of the dermis insufficient to properly stimulate nerves and blood vessels. If the weight of the hoop is increased to compensate for the resultant reduction in force per unit area, the hoop may become too heavy to operate properly.

The following Table 1 lists the relationships existing between the desired massage effect and the shape, cross-sectional area, and distance between protrusions and the weight of the hoop. Because a variety of protrusion shapes may be used, many tapering to a tip as they extend from the inside outer surface, it is difficult to define a required cross-sectional area at a given elevation of a protrusion that would apply to all shapes and tapers of protrusions. Therefore, it is helpful to speak in terms of the greatest cross-sectional area of the resultant depression in the dermis formed by a protrusion rather than a cross-sectional area taken from the protrusion itself. In effect, this area or distance between depressions defines the area or distance between protrusions measured at the skin line, i.e., where the skin line meets the protrusion. Due to the elastic nature of the dermis, the greatest cross-sectional area of a depression can always be measured at a level flush with the surrounding uncompressed dermis, regardless of the shape and angle of taper of a protrusion.

In accordance with the above discussion, Table 1 lists the requisite cross-sectional areas of a protrusion in terms of the maximum cross-sectional area of the resultant depression. Similarly, the requisite distance from a protrusion to the next nearest protrusion is listed in terms of the distance from an edge of the resultant depression to the edge of the next nearest depression.

TABLE 1

Hoop Dimension Ranges and Resultant Massage Effects

| Effect | Protrusion Shape | Maximum Cross Sectional Area of a Depression ($mm^2$) | Height of Protrusion (mm) | Load/ Protrusion (gm) | Distance Between Depressions (mm) | Hoop Weight (gms) |
|---|---|---|---|---|---|---|
| Light Tonic Massage | Bristle | 0.1-3 | 3-15 | 3-12 | *2-40/$cm^2$ | 250-900 |
| Light Massage | cone or rib | 2-15 | 3-10 | 10-20 | 3-25 | 250-900 |
| for Overweight People | cone or rib | 6-12 | 6-10 | 15-20 | 4-15 | 300-500 |
| Deep Massage | cone or rib | 12-50 | 4-20 | 20-40 | 10-25 | 250-900 |
| for Overweight People | cone or rib | 12-50 | 10-20 | 20-40 | 15-25 | 300-600 |
| Skin and Muscle Massage | cone or rib | 50-200 | 10-30 | 30-300 | 20-80 | 250-950 |
| for Overweight People | cone or rib | 50-120 | 15-30 | 35-150 | 25-80 | 300-650 |

*Density of Bristle Distribution

In addition, Table 1 suggests that the optimum distance from the edge of the area of contact between a protrusion and the skin to the next such edge can be expressed as a function of the depth of the depression. For example, the best light massage is produced when the distance between depressions is three to five times the depth of a depression. A spacing of six to seven times the appropriate depth is the optimum for a deep massage. And a massage of the skin and muscle can be produced best when the distance is over seven times the depth of the depression.

If desired, a combination of massage effects can be delivered by my invention if the shape, height, and spacing of protrusions are varied on a single inside outer surface.

Figure 3:
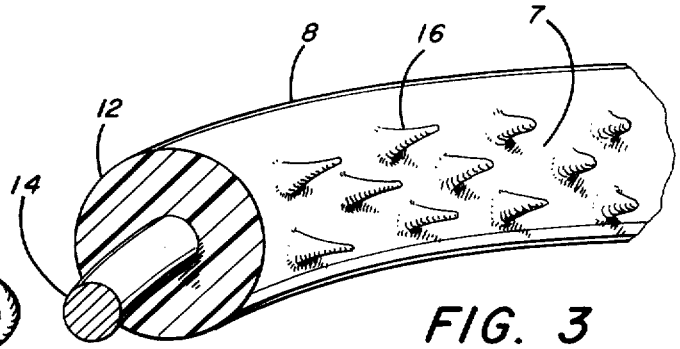
FIG. 3 is a sectional elevation of an embodiment of the massage hoop which comprises a metal core encased in a flexible covering containing the protrusions.

One embodiment of the massage hoop 10, depicted in FIG. 3, comprises a substantially rigid rod 14, preferably of metal, bent formed into a hoop and having a coating 12 of resilient material, preferably foam plastic or foam rubber, and formed into the hoop member 8. The protrusions 16, located on the inside outer surface 7 are normally an integral part of the coating. The protrusions are basically frustoconical in shape terminating in a blunt or slightly rounded end so as to avoid piercing the skin of the user.

Figure 4:
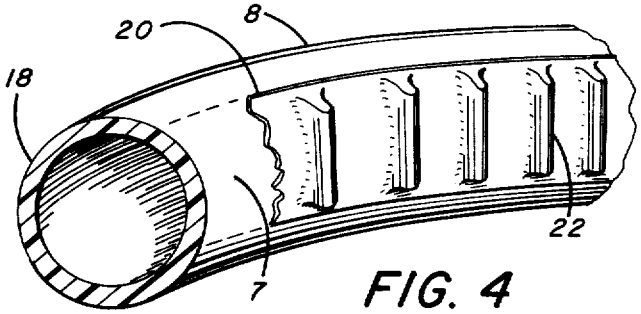
FIG. 4 is a sectional elevation of an embodiment of the massage hoop which comprises a tube on which is attached a flexible strip containing rib-shaped protrusions.

Another embodiment of the massage hoop 10 is formed by attaching a protrusion carrying member or strip 20 to the inside outer surface 7 of the hoop member 8 made from an extruded plastic cylinder 18, which may be solid or tubular, FIG. 4. The protrusion carrying member comprises the flexible flat strip 20, preferably of plastic, attached to the inside outer surface 7 of the hoop member 8 through the use of an adhesive, heat fusion, or stapling. The flexible flat strip 20 can have the protrusions stamped or molded onto it which can be in the form of ribs 22 parallel to or angularly disposed with the central axis of the hoop. Again the ribs are defined by sloped side surfaces terminating and connected by a slightly rounded end so as to provide the desired massage effect.

Figure 5:
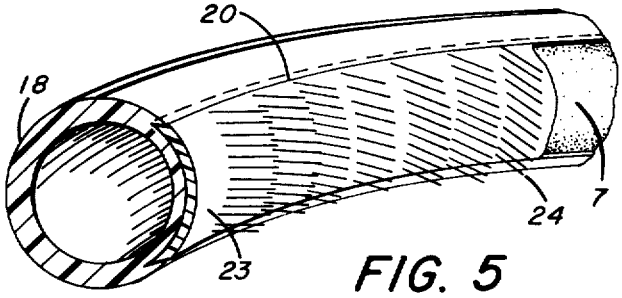
FIG. 5 is a sectional elevation of an embodiment of the massage hoop which comprises a grooved tube which dovetails with a flexible strip containing bristle-shaped protrusions.

The protrusion carrying member 20 can be shaped to dovetail with a slot 23 formed on the inside outer surface 7 of the extruded tube 18, FIG. 5. The protrusions extending from the surface of the protrusion carrying member can be in the form of bristles 24 made from plastic or nylon. The bristles are normally positioned in dense clusters so that the clusters can be spaced to optimize the massage effect.

Figure 6:
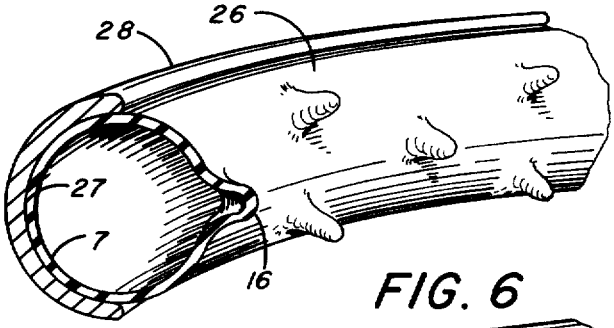
FIG. 6 is a sectional elevation of an embodiment of the massage hoop which comprises a hoop-shaped rim and protrusion carrying tube.

Another embodiment of the massage hoop 10 consists of a hoop member 28 having a U-shaped cross section such that the concavity 27 of the hoop member 28 comprises the inside outer surface 7 of the hoop member 28, FIG. 6. The concavity of the hoop member 28 is shaped to receive and constrain an annular inflatable tube 26, preferably made of rubber or plastic, which when inflated, fits securely against the concavity of the hoop member 28. The protrusions 16 are located on the inside outer surface of the annular inflatable tube 26 and are an integral part of the surface thereof.

Figure 7:
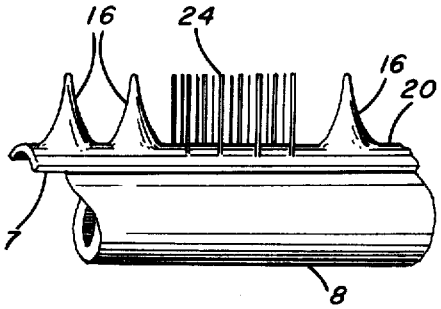
FIG. 7 is a sectional elevation of an embodiment of the massage hoop which comprises a tube on which is mounted a protrusion carrying member having variegated protrusion shapes, sizes and spacings.

A massage hoop can be constructed to deliver a combination of massage effects, FIG. 7. This is accomplished by attaching to the inside outer surface 7 of the hoop member 8 a protrusion carrying member 20 fitted with a multiplicity of protrusions 16 varying in height, shape and spacing. To include a light tonic stimulation of the dermis among the desired massage effects, bristle-shaped protrusions 24 may be added to this arrangement.

Figure 8:
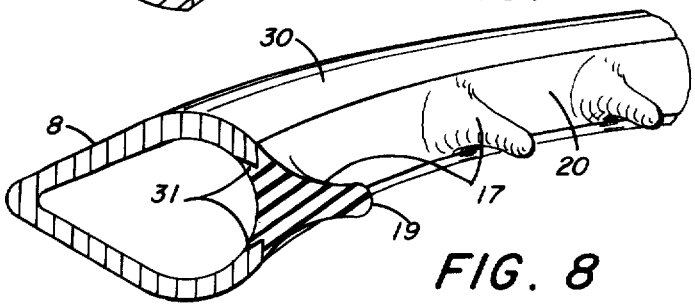
FIG. 8 is a sectional elevation of an embodiment of the massage hoop which comprises a rigid channel fitted with a protrusion carrying member.

For optimum economy in fabrication and use of materials, the hoop member 8 preferably consists of a channel 30 formed from a flat strip of metal by bending the opposing longitudinal edges 31 toward each other partially enclosing a side of the strip leaving a gap, FIG. 8. The metal channel 30 is bent to form the hoop member 8 so that the gap is disposed about the inside circumference of the hoop. A flexible protrusion carrying member 20, preferably made of plastic or rubber, is inserted in the gap so that the protrusions 17 extend from the member toward the waist and are held securely by the opposing longitudinal edges of the hoop. The protrusions 17 preferably are conical-shaped having a slightly rounded tip 19 sufficiently blunt to prevent puncture of the skin.

I claim:

1. A massage hoop which comprises:

A. a rigid hoop member having a circumference suitable for rotation about a person's waist by a hula-type motion of the person, said hoop member having an inside outer surface facing the waist; and B. a multiplicity of protrusions fitted about and radially extending inwardly from the inside outer surface so that the protrusions successively engage the waist as the massage hoop is rotated, said protrusions having a height, measured from the inside outer surface of the hoop member, of from 3 to about 30 millimeters and having a spacing between a protrusion and a next nearest protrusion sufficient to create a multiplicity of distinct depressions in the waist as said protrusions engage the waist.

2. The massage hoop as recited in claim 1 wherein the massage hoop has a weight of from about 250 to about 950 grams.

3. The massage hoop as recited in claim 2 wherein said protrusions have a spacing between a protrusion and a next nearest protrusion sufficient to create a multiplicity of distinct depressions in the waist, said depressions having a distance to a next nearest depression of from 3 to about 80 millimeters.

4. The massage hoop as recited in claim 3 wherein said protrusions have a cross-sectional area sufficient to create depressions measured at the widest portion thereof of from 0.1 to about 200 square millimeters.

5. The massage hoop as recited in claim 1 wherein the hoop member comprises a metal rod formed into a circle, said rod having a coating of resilient material on which are formed the protrusions.

6. The massage hoop as recited in claim 1 wherein the hoop member comprises an extruded plastic cylinder or rigid profile and the protrusions are formed on a protrusion carrying member, said protrusion carrying member being attached to the inside outer surface of the hoop member.

7. The massage hoop as recited in claim 3 wherein the hoop member further comprises a slot extending circumferentially along the inside outer surface thereof and shaped to receive the protrusion carrying member.

8. The massage hoop as recited in claim 1 wherein the hoop member has a U-shaped cross section such that the concavity of the hoop member faces the waist and an inflatable annular tube of a sufficient outside diameter to engage the concavity of the hoop member, said inflatable annular tube having a surface facing the waist, said surface bearing the protrusions.

9. The massage hoop as recited in claim 1 wherein said protrusions comprise a first set and at least a second set, said second set differing from said first set in at least one of height, spacing and cross-sectional area.

10. The massage hoop as recited in claim 1 wherein the loop member comprises a channel having a gap disposed about the inside circumference thereof and a protrusion carrying member of sufficient width and length to fit securely in said gap, said protrusion carrying member having protrusions fitted along its length on a side facing the waist.

11. The massage hoop as recited in claim 1 wherein the protrusions are cone-shaped, having a tip sufficiently blunted to prevent puncture of the waist as the protrusions form a depression therein.

12. The massage hoop as recited in claim 1 wherein the protrusions are bristle-shaped and disposed about the inside outer surface of the hoop member such that from 2 to about 40 bristle-shaped protrusions are present on each square centimeter of the inside outer surface.

13. The massage hoop as recited in claim 1 wherein the protrusions are in the form of ribs oriented one of parallel and angularly disposed to the central axis of said massage hoop.

* * * * *